United States Patent [19]

Richter

[11] 3,935,156

[45] Jan. 27, 1976

[54] UNIT AND METHOD FOR SPRAY COOLING FLUID

[75] Inventor: Harvey E. Richter, Farmington, Conn.

[73] Assignee: The Tec Group, Inc., Bloomfield, Conn.

[22] Filed: Aug. 4, 1972

[21] Appl. No.: 277,988

[52] U.S. Cl. ..... 261/37; 210/242; 261/91; 261/120

[51] Int. Cl. ..... B01f 3/04

[58] Field of Search ..... 261/91, 37, 120, 29; 210/242; 417/356

[56] References Cited

UNITED STATES PATENTS

| | | | |
|---|---|---|---|
| 3,101,173 | 8/1963 | Jennings | 261/91 X |
| 3,276,382 | 10/1966 | Richter | 417/356 X |
| 3,320,160 | 5/1967 | Welles, Jr. et al. | 261/120 X |
| 3,497,185 | 2/1970 | Dively | 210/242 X |
| 3,535,236 | 10/1970 | Travis | 210/242 X |
| 3,557,960 | 1/1971 | Fitzgerald et al. | 210/242 |
| 3,622,074 | 11/1971 | Frohwerk | 261/120 X |
| 3,735,926 | 5/1973 | Ravitts | 261/120 X |

*Primary Examiner*—Tim R. Miles
*Assistant Examiner*—Richard L. Chiesa
*Attorney, Agent, or Firm*—Prutzman, Hayes, Kalb & Chilton

[57] ABSTRACT

An open-ended cylindrical tower having an upper outlet end and a lower inlet end with a coaxial open center pump intermediate the inlet and outlet ends of the tower for imparting relatively high kinetic energy to fluid to be passed through the tower with a vortical motion under relatively low pressure, and a velocity deflector at the outlet end of the tower jointly defining therewith an unobstructed annular discharge opening and serving to at least partially deflect the axial velocity of the fluid and amplify its angular escape velocity through the discharge opening to effect a 360° radiating spray pattern while minimizing pressure drop during discharge. The method of spray cooling fluid utilizes the effect of centrifugal forces previously imparted during a pumping operation and significantly amplifies such centrifugal forces by deflection of the axial velocity of the fluid upon its escaping from confinement of the tower to further increase the angular velocity of such fluid radially of its spin axis upon discharge.

3 Claims, 5 Drawing Figures

UNIT AND METHOD FOR SPRAY COOLING FLUID

This invention generally relates to an apparatus and process for handling fluids and particularly concerns an apparatus and method for cooling heated fluids such as water.

A primary object of this invention is to provide a new and improved fluid cooling unit incorporating a fluid propulsion unit of an axial flow type capable of slinging fluid to be cooled such as water into the atmosphere in the form of droplets which are exposed to atmosphere during a relatively prolonged period of time based on the energy expended for maximizing the heat transfer efficiency of the unit.

Another object of this invention is to provide a new and improved cooling unit of the type described which is designed to effectively control the droplet size and trajectory of the effluence discharged from the unit.

Still another object of this invention is to provide such a cooling unit particularly suited for cooling massive bodies of thermally polluted water such as that discharged, e.g., from atomic powered generating plants.

A further object of this invention is to provide a new and improved fluid cooling unit of significantly simplified, compact construction with few moving operating components and which is quick and easy to manufacture and assemble on an economical basis and may be used in conjunction with other such units for increased effectiveness. Included in this object is the aim of providing a group of such units constituting a cooling system for extensive heat transfer requirements wherein each unit serves as a modular cooling station which may be independently positioned and controlled, removed, replaced, or shut down, as desired, without requiring total system shutdown.

A still further object of this invention is to provide such a cooling unit which is also quick and easy to install and service and which is a stable, seaworthy unit particularly suited to meet a variety of different performance requirements over a broad range of demanding wind, current and tide conditions.

Another primary object of this invention is to provide a new and improved method of cooling a heated body of fluid by spraying the fluid into atmosphere in the form of droplets of an optimum size through a controllable trajectory for maximizing the cooling efficiency of the unit.

Still another object of this invention is to provide such a method particularly suited to effect a practical, efficient process of heat dissipation of a thermally polluted body of water and which is readily controlled to ensure that substantially all water discharged into the atmosphere is returned to cool the heated body of water with minimum loss of the discharged water due to wind drift in a continuous trouble-free process.

A further object of this invention is to provide such a new and improved method for continuous high volume heat transfer applications utilizing a system which is relatively inexpensive to install, operate and maintain.

Other objects will be in part obvious and in part pointed out in more detail hereinafter.

This invention accordingly comprises the several steps and the relation of one or more of such steps with respect to each of the others and the apparatus possessing the features, properties and the relation of elements exemplified in the following detailed disclosure which also sets forth an illustrative embodiment of the apparatus employed in this invention indicative of the way in which the principle of this invention is employed.

In the drawings:

FIG. 2 is a side elevational view, partly broken away and partly in section, of the unit of FIG. 1 on an enlarged scale;

Figure 1:
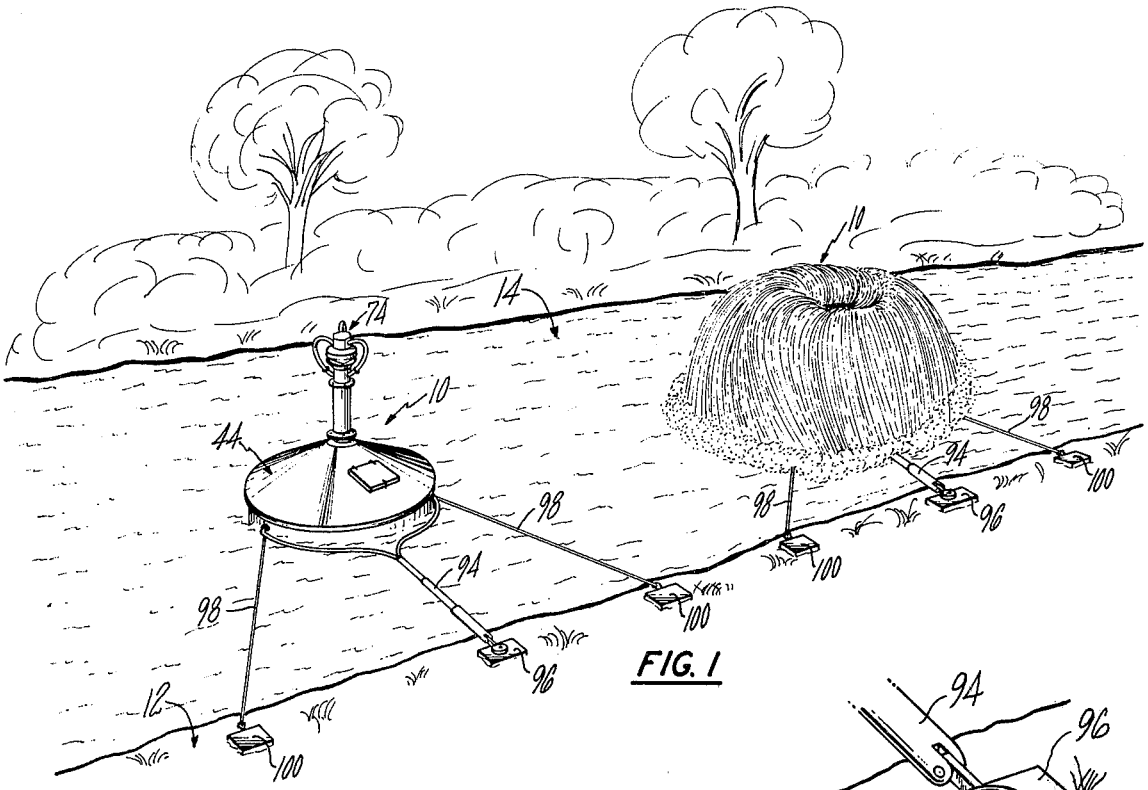
FIG. 1 is a pictorial representation of a system incorporating the fluid cooling unit of this invention.

Referring to the drawings in detail wherein a preferred embodiment of the fluid cooling unit of this invention is illustrated, two units such as at 10 are shown independently moored to a shore 12 of a body of water 14 which may be assumed to be thermally polluted, such as a discharge canal downstream from an atomic powered generating plant. While the apparatus and method of this invention are particularly useful in cooling such massive bodies of fluid and will be described in connection with the cooling of water for the purposes of explanation of this invention, it is to be understood that this invention is equally useful in a variety of different applications wherein a body of heated fluid is to be cooled by discharging that fluid into the atmosphere in such a way as to achieve maximum heat transfer for energy expended and, through air contact and evaporation, temperature reduction of the discharge fluid which falls back into the thermally polluted body of fluid to reduce its temperature in a continuous process.

Unit 10 incorporates an axial flow pump 16 of a general type described in my U.S. Pat. No. 3,276,382, entitled "Fluid Flow Device" and issued Oct. 4, 1966. In the specifically illustrated embodiment of the flow device described in that patent, the rotor is shown as being an axially unobstructed cylindrical member. While subject to obvious modifications, pump 16 is preferably provided with a substantially open center rotor 18 with an impeller arrangement wherein a plurality of equally spaced blades such as at 20 are integrally formed on and extend radially inwardly of the inside wall of the rotor 18. If desired, pump 16 may be provided with single or plural impeller stages having blades 20 of a selected shape and curvature and predetermined pitch such that, upon rotation of the rotor or rotors in a selected angular direction, a powerful vortical motion (as represented by upwardly spirally lines at 22 and 24) is imparted by the pump 16 through the flow passageway 26 of the rotor 18 and downstream through a connected discharge line. The axial flow pump 16 thus imparts energy to the water to move it with an upwardly swirling or vortical motion along an axis X—X to provide both axial and angular momentum to the water to rotate it downstream of the rotor 18 as a solid column through the confining downstream line.

In the specifically illustrated embodiment of this invention, rotor 18 is disposed for rotation about a vertical axis in line with a cylindrical upright tower 28 having a conical inlet end 30 converging into continuation with a supply conduit 32 upstream of pump 16 and a discharge line 34 downstream of the pump 16 which terminates in an outlet 36 at an open upper end of the tower 28. The inlet end 30, supply conduit 32, rotor 18 and discharge line 34 are coaxially aligned with their inside diameters preferably of approximately equal dimension for minimizing any friction losses in the flow passage through the tower 28. Obviously, the lower inlet end 30 of the tower 28 is suited to be immersed in a body of fluid such as water which is to be cooled and which will be drawn into the rotor 18 as its rotating blades 20 drive the column of water upwardly through the tower 28. Motor 38 is suitably mounted in fixed relation to tower 28 to rotate input shaft 40 drivingly connected through suitable gearing, not shown, within gear housing 42 wherein bearing support may be provided for rotor 18 as described in my copending United States patent application Ser. No. 236,433 filed Mar. 20, 1972, entitled "Improved Mechanical Seal," and assigned to the assignee of this invention.

Tower 28 is mounted on a portable float structure shown in the form of a shell 44 enveloping the pump 16 and its associated gear housing 42 and motor 38. The shell 44 includes a generally cylindrical housing 46 having a closed bottom wall 48 with a recessed center portion 50 providing an opening within which is fitted the conical inlet end 30 of the tower 28. An annular platform 52 provides a base for mounting both the pump 16 and a motor supporting bracket 54. Shell 44 is in concentric surrounding relation to the tower 28, and the tower discharge line 34 is suitably secured to pump housing 56 to extend upwardly through an opening in an apertured supporting member 58 secured on an apex of a conical roof 60 of the shell 44. Ballast compartments are preferably provided within the shell housing 46 in surrounding relation to the tower 28 and may be sealed by suitable fluid tight covers, as indicated by broken lines at 62, for stabilizing unit 10 upon its being installed in the water.

For further ensuring that fluid cooling unit 10 will be statically stable under rugged and demanding conditions which may sometimes be of hurricane magnitude in certain installations, unit 10 is made still more seaworthy by the disclosed conical shape of its sloping roof 60 which is exposed above the water with an upwardly tapered cross-sectional configuration providing a relatively streamlined profile which effectively minimizes the surface area exposed to wind. Roof 60 is also preferably provided with a conventional releasable latch 64 permitting swinging movement of the roof 60 about a suitable hinge connection 66 to the housing 46, and a releasable hatchway 68 is shown provided on the roof 60 for quick and easy entry into the interior of the unit 10 for servicing its pump 16 and associated motor unit. Both the hatchway 68 and the roof 60 will be understood to be provided with conventional fluid tight seals, not shown, for preventing entry of water, or other undesired contaminants into the interior of the shell 44.

Quick and easy assembly, disassembly and servicing is further facilitated by the disclosed articulated construction of the tower 28. Upon releasing the illustrated bolts at 70 and 72, an upper terminal portion of the tower 28 above the roof 60 may be removed and its intermediate portion 28A mounted on the apex of the roof 60, is free to pivot away from pump housing 56 upon swinging open the roof 60 of shell 44 about its pivotal hinge connection 66.

In the illustrated design, an 8 inch diameter pump rotor 18 and 40 horsepower rating of motor 38, e.g., will provide a nominal flow of 4,000 gallons per minute through the virtually clog-free open center impeller passageway 26 to a corresponding 8 inch diameter discharge line 34. The pump 16 effects virtually no flow diversion or flow restriction and accordingly will operate at a low pressure head under high volume conditions with few pressure drops, and any inefficiency in its impeller is mainly swirl.

By virtue of this invention swirl or vortical velocity is utilized as a spray velocity. More specifically, the axial velocity of fluid through the tower 28 under the above design specifications would be about 35 feet per second with an angular spin velocity of about 42 feet per second being imparted by the pump 16 to the water around the inside wall of tower 28. As water is thrust upwardly through the tower 28, the angular spin velocity is amplified upon discharge in accorance with this invention as the water breaks out of confinement from the tower 28 to effect a highly efficient slinging action over a generally circular spray area which may be approximately 110 feet in diameter with a resulting spray density of 0.4 gallons per minute per square foot.

Figure 3:
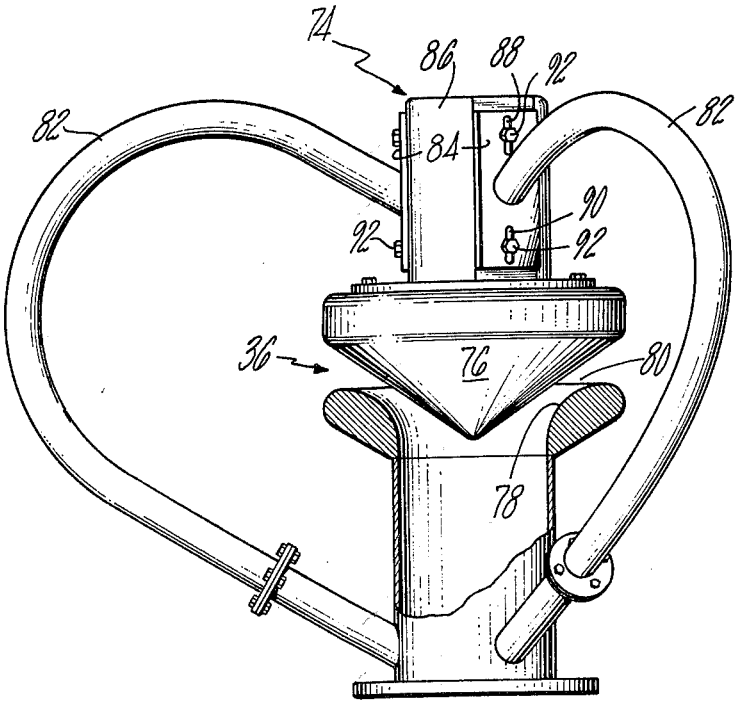
FIG. 3 is an enlarged view, partly broken away and partly in section, showing a detail of the unit of FIG. 1.
Figure 4:
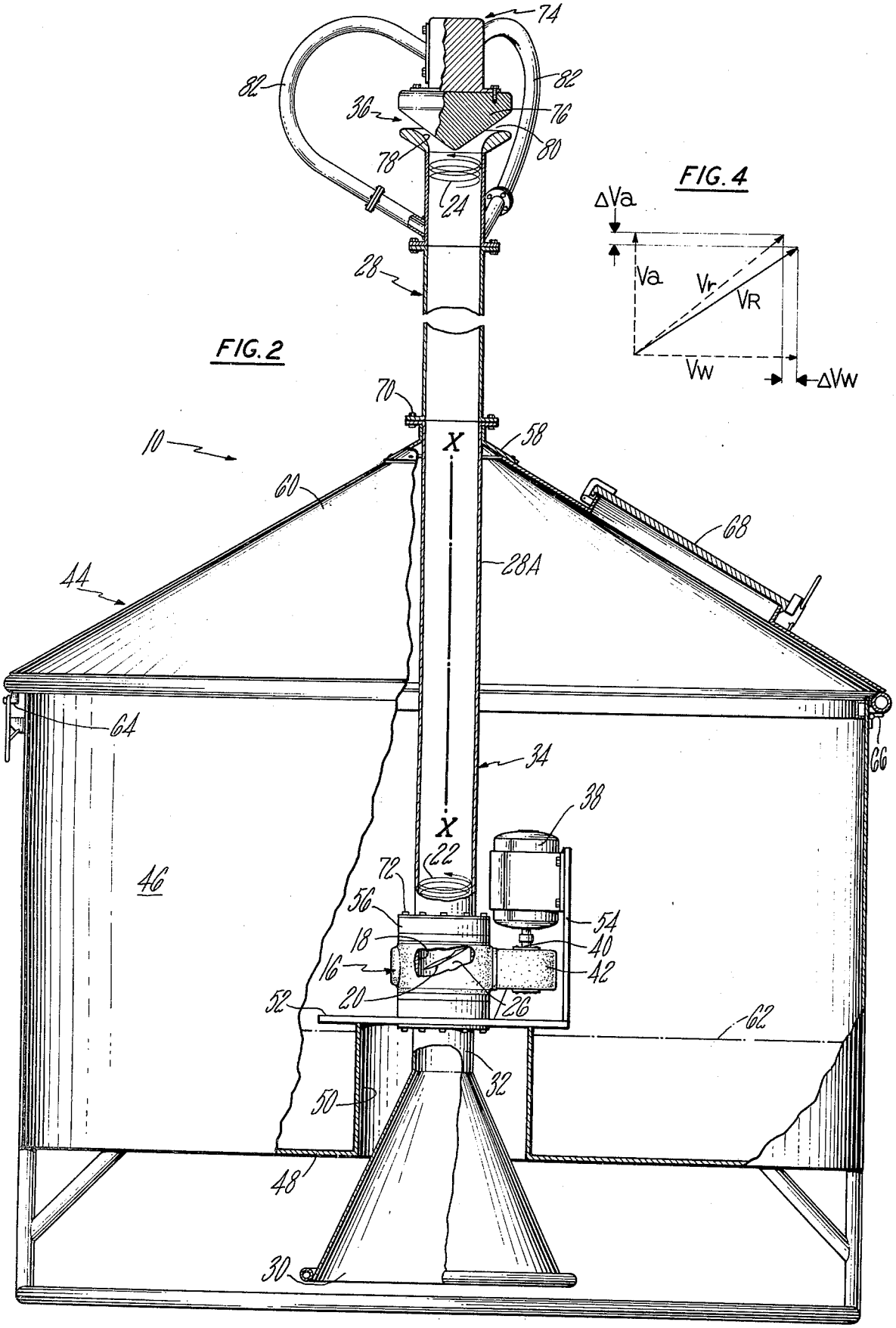
FIG. 4 is a vector diagram showing the relationship of angular and axial velocities of the fluid during its confinement in a tower of the cooling unit and during its escape from the tower.

To amplify the angular escape velocity of the water at the discharge outlet 36 of the tower 28 in accordance with this invention, a velocity deflector 74 is mounted adjacent the tower outlet 36 and is designed to deflect the axial velocity of the water radially outwardly relative to its vortical axis X—X. In the specifically illustrated embodiment, the velocity deflector 74 is shown in the form of a downwardly directed conical member 76 secured in coaxially fixed relation to the tower 28 at its outlet 36 and jointly defining with the mouth 78 of tower 28 an unobstructed annular opening or annulus 80 which permits slinging of the fluid in a 360° radiating spray pattern. The mouth 78 of the tower 28 is shown (FIG. 3) having a lip of arcuate cross-section which smoothly extends radially outwardly from the inside diameter of the tower discharge line 34 for streamlined discharge of water with minimized turbulence and friction losses into atmosphere through the annulus 80 formed between the mouth 78 of the tower 28 and its velocity deflector conical member 76. FIG. 4 shows a diagram wherein axial and angular velocities of water confined within the tower 28 are represented by velocity vectors $V_a$ and $V_w$ shown in broken lines. Upon engagement with the velocity deflector, the resultant velocity vector $V_R$ (shown in full lines) of the escaping water is not substantially changed in its magnitude from that of resultant velocity vector $V_r$ (shown in broken lines) of the confined water and is not thereby significantly affected by the deflector 74 although the direction of the water is changed upon its breaking out of confinement. This change is indicated by a reduction $\Delta V_a$ in the axial velocity vector and an increase $\Delta V_w$ in the angular velocity vector of the fluid upon discharge through the relatively wide passage area of the circumferentially extending annulus 80 at the top of the tower 28.

Accordingly, water pumped through the tower 28 is done so with minimum pressure drops in an efficient high volume, low pressure pumping operation. The relatively high kinetic energy given to the water by the pump 16 is not substantially affected by its discharge from the top of the tower. The apparatus and method of this invention accordingly expose more water in the air for a longer period of time for the horsepower used. The water droplets are also maintained in the air for a prolonged period of time by the slinging action of the unit 10 while at the same time being particularly suited to provide slinging of water droplets of an optimum size over a preselected trajectory.

To control water droplet size and spray trajectory over a selected area in relation to the nominal flow and pressure head of each unit 10 of the system, the velocity deflector 74 of each unit 10 is preferably linearly adjustable relative to the axis of its tower 28 and therefor, the axis X—X of the vortical movement of the water, for varying the discharge area of the circumferentially extending annulus 80. More specifically, three substantially identical arcuate mounting arms 82 are secured at 120° spacing on the outside of each tower 28 below its upper open discharge outlet 36. Each mounting arm 82 carries a vertically disposed plate 84 to be adjustably clamped in a desired selected position on an upright stem 86 of the velocity deflector 74. While the adjustable arm mounting arrangement may be achieved by any suitable means, the illustrated embodiment in FIG. 3 shows one arrangement wherein each mounting plate 84 has upper and lower vertically extending slots 88, 90 for receiving conventional fasteners such as 92 for securing the plate 84 to the stem 86 of the velocity deflector 74, thereby permitting its being selectively positioned in an aligned coaxial position relative to the discharge outlet 36 of the tower 28.

Figure 5:
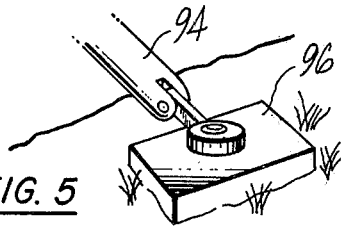
FIG. 5 is an enlarged perspective view of a shore mooring for the fluid cooling unit of FIG. 1.

In addition, each floating modular fluid cooling unit may be easily tethered near the center of a canal, e.g., to minimize any water loss by wind drift. For positioning each unit 10, a rigid telescoping boom 94 of a well known conventional type is pivotally mounted to opposite sides of unit 10 and to a shore mooring 96 and will be understood to have a conventional hinge connection, best seen in FIG. 5, between the fixed end of the boom 94 and mooring 96 permitting raising and lowering of the unit with varying tide conditions. Boom 94 is selectively extendible and retractable to permit selective positioning of unit 10 relative to the shoreline. Steel cables 98 are also shown secured to diametrically opposed sides of unit 10 and fixed to moorings 100 to further secure the unit 10 in desired position while permitting its being raised and lowered under wave and tidal action. By such construction, it will be seen that each unit 10 may be individually positioned as required under variable wind, wave and tide conditions in relation to the adjoining shore of the body of thermally polluted water to be cooled.

Most importantly, any undesired spraying of "mist" of undesirably small droplet size is eliminated thereby to minimize any loss in trajectory control over the discharged fluid upon its escape from the tower 28 and undesirably being carried by wind onto adjacent land surfaces which would reduce the efficiency of the cooling unit 10. Minimal loss in efficiency due to any large pressure drops is also avoided as normally experienced with conventional spray units which utilize a so-called nozzle effect with relatively large discharge pressure drops and resulting spraying of "mist" and loss of control over its trajectory. Maintenance requirements are also minimized, particularly since few moving parts are utilized in the system, and the power operated pump 16 can be readily lifted by two men. The resulting effluent discharged from the cooling tower 28 will have a highly dissolved oxygen content providing an additional important advantage of economically restoring to normal the biochemical dissolved oxygen count in a body of water which is to be cooled. Installation costs for a series of floating modules are low, and no extensive piping is required. If desired, the modular units 10 may be positioned much more closely together than depicted in FIG. 1 with some overlap of spray in a body of water which presents an excessively high heat load. Control of each unit 10 or combination of units may be achieved with conventional electrical controls, preferably at a central terminal, and while one unit may be dropped out of the system for any desired reason, shutdown of one unit will not require total system shutdown. The open central axial flow pump 16 not only imparts an exceedingly high angular velocity to the fluid being pumped but accordingly encounters little or no problem in pumping up muck, mud, shellfish and the like without clogging and without requiring any screening whatsoever as normally required in pumps of conventional centrifugal design.

As will be apparent to persons skilled in the art, various modifications, adaptations and variations of the foregoing specific disclosure can be made without departing from the teachings of the present invention.

I claim:

1. A modular fluid cooling unit for cooling a body of water and the like and comprising a generally cylindrical stationary tower having a flow passage therethrough with a discharge outlet at an open upper end of the tower and an inlet at its lower end, a power operated axial flow pump between upper and lower ends of the tower, the pump including a cylindrical rotor with an axial flow passageway coaxially aligned with the tower and forming part of its flow passage, the cylindrical rotor forcing fluid through the tower with a vortical motion of relatively high kinetic energy and under relatively low pressure, a velocity deflector mounted on the tower, the velocity deflector including a downwardly directed conical portion in coaxially fixed relation to the tower at its discharge outlet and jointly defining with the tower a substantially unobstructed annulus permitting slinging of fluid in a 360° radiating spray pattern from the discharge outlet, the conical deflector portion amplifying the angular escape velocity of the fluid by at least partial deflection of the axial velocity of the fluid at the discharge outlet of the tower, a float structure for supporting the tower, the pump and the velocity deflector, the float structure including a fluid tight shell enveloping the pump, the shell extending above the water surface being of an inverted cone shape providing a downwardly sloping surface radiating in surrounding symmetrical relation to the tower for minimizing surface area exposed to wind for improved seaworthiness.

2. A modular fluid cooling unit for cooling a body of water and the like and comprising a generally cylindrical stationary tower having a flow passage therethrough with a discharge outlet at an open upper end of the tower and an inlet at its lower end, a power operated axial flow pump between upper and lower ends of the tower, the pump including a cylindrical rotor with an axial flow passageway coaxially aligned with the tower and forming part of its flow passage, the cylindrical rotor forcing fluid through the tower with a vortical motion of relatively high kinetic energy and under relatively low pressure, a velocity deflector mounted on the tower, the velocity deflector including a downwardly directed conical portion in coaxially fixed relation to the tower at its discharge outlet and jointly defining with the tower a substantially unobstructed annulus permitting slinging of fluid in a 360° radiating spray pattern from the discharge outlet, the conical deflector portion amplifying the angular escape velocity of the fluid by at least partial deflection of the axial velocity of the fluid at the discharge outlet of the tower, a float structure for supporting the tower, the pump and the velocity deflector, the float structure including a fluid tight shell enveloping the pump, a rigid adjustable shore anchored arm being secured to the shell, and a pair of cables fixed between the shell and shore moorings on opposite sides of the rigid adjustable arm.

3. The cooling unit of claim 2 wherein a shore mooring is provided with a pivotal connection to the rigid adjustable arm, permitting raising and lowering of the unit relative to its moorings.

* * * * *